US005904172A

United States Patent [19]

Gifft et al.

[11] Patent Number: 5,904,172

[45] Date of Patent: May 18, 1999

[54] VALVE ENCLOSURE ASSEMBLY

[75] Inventors: James Edwin Gifft, Maple Grove; Paul James Mahoney, Stillwater, both of Minn.

[73] Assignee: Select Comfort Corporation, Minneapolis, Minn.

[21] Appl. No.: 08/901,144

[22] Filed: Jul. 28, 1997

[51] Int. Cl.[6] ..... A47C 27/08

[52] U.S. Cl. ..... 137/224; 137/271; 137/596.16; 137/596.2; 5/710; 5/713

[58] Field of Search ..... 137/223, 229, 137/596.2, 596.16, 884, 271; 5/710, 713

[56] References Cited

U.S. PATENT DOCUMENTS

| | | | |
|---|---|---|---|
| 2,685,906 | 8/1954 | Willimas | 137/224 X |
| 3,513,876 | 5/1970 | Tarbox | 137/884 X |
| 4,427,022 | 1/1984 | Forney | 137/224 |
| 4,583,566 | 4/1986 | Kalavitz et al. | 137/224 X |
| 4,745,647 | 5/1988 | Goodwin | 5/713 |
| 4,797,962 | 1/1989 | Goode | 5/713 |
| 4,890,344 | 1/1990 | Walker | 5/713 |
| 4,915,124 | 4/1990 | Sember | 137/223 |
| 5,095,568 | 3/1992 | Thomas et al. | 5/713 |
| 5,509,154 | 4/1996 | Shafer et al. | 5/713 |
| 5,542,136 | 8/1996 | Tappel | 5/710 |

*Primary Examiner*—John Rivell
*Assistant Examiner*—Meredith H. Schoenfeld
*Attorney, Agent, or Firm*—Patterson & Keough, P.A.

[57] ABSTRACT

An improved valve enclosure assembly for use with an air inflatable mattress includes at least one air bladder, a pump fluidly coupled to the at least one air bladder for providing compressed air thereto, and a processor for providing commands to the improved valve enclosure assembly during an inflate/deflate cycle. The improved valve enclosure assembly is fluidly coupled intermediate the pump and the at least one air bladder for controlling the inflation of the at least one air bladder. An enclosure defines a substantially fluidly sealed air chamber and has at least one air inlet to the air chamber being fluidly coupled to the pump. A pressure monitor is operably coupled to the processor and is in fluid communication with the at least one bladder for continuously monitoring the pressure in the at least one bladder. A method of effecting a desired pressure in a bladder of an air inflatable mattress is also disclosed.

18 Claims, 7 Drawing Sheets

100
130
132
133
136
140
143
152
182
202
216
142
144
146
148
150
134
138
204
206
208
210
211
212
214
164
168
170
174
176
178
180
184
186
188
194
196
198
200
218
220
224
226
232
234
236
240

VALVE ENCLOSURE ASSEMBLY

TECHNICAL FIELD

The present invention relates to an electric pump for use with an inflatable mattress. More particularly, the present invention relates to an improved valve enclosure assembly used to control the pressure in the inflatable mattress and method to inflate the mattress.

BACKGROUND OF THE INVENTION

A prior art valve enclosure assembly is shown generally at 10 in FIG. 1. Valve enclosure assembly 10 is preferably coupled to a pump 12. The pump 12 is preferably electrically powered by common household current through cord 13. The pump 12 is mounted on a base 14. An air inlet 16 defined in the base 14 provides inlet air to the pump 12. Pressurized air is discharged from the pump 12 into the valve enclosure assembly 10 through an air outlet 18 defined in the rear face of the valve enclosure assembly 10. A processor board 20 is mounted on the upper surface of the pump 12. A left pressure sensor 22 and a right pressure sensor 24 are mounted on the processor board 20.

The prior art valve enclosure assembly 10 is formed of two major subcomponents; enclosure 26 and front face 28. The enclosure 26 has four sides and a rear face. After the various valve components have been mounted within the enclosure 26, the front face 28 is chemically bonded to the enclosure 26.

A right air outlet 30 is defined within outlet sleeve 32. A left air outlet 34 is defined within the left outlet sleeve 36. The outlet sleeves 32, 36 are formed integral with the front face 28 and project outward therefrom such that an air hose may be slipped over the outer surface of the outlet sleeves 32, 36. A monitor port 38 may be formed on the outlet sleeve 32. The monitor port 38 is fluidly coupled to the right air outlet 30. Likewise, a monitor port 40 is formed on the outlet sleeve 36 and is fluidly coupled to the left air outlet 34. Pressure monitor tubes 42 couple the outlet sleeves 32, 36 to the right pressure sensor 24 and the left pressure sensor 22, respectively.

A right and left solenoid (not shown) are mounted within the prior art valve enclosure assembly 10. Each solenoid has a shiftable plunger (not shown) coupled thereto. A sealing disk (not shown) is mounted on the end of the plunger. In the closed configuration, the sealing disks close the right air outlet 30 and the left air outlet 34 by sealingly engaging the inner peripheral surface of the respective outlet sleeves 32, 36. A coil spring (not shown) is mounted concentric with the plunger between solenoid and the sealing disk to bias the sealing disk to the closed configuration, thereby fluidly sealing the mattress off from the prior art valve enclosure assembly 10.

In operation of the prior art device, a command is received by the processor board 20 to inflate either the right or the left bladder of the mattress, as selected. The pump 12 is energized, drawing air in through air inlet 16, compressing the air, and discharging the compressed air into the valve enclosure assembly 10 through air outlet 18. The pressure differential between the commanded pressure and the existing pressure in either the right or left bladder is determined by the processor board 20 using inputs from either the left pressure sensor 22 or the right pressure sensor 24. The left or right solenoid is actuated opening the sealing disk on the right air outlet 30 or left air outlet 34, as selected, to inflate the desired bladder of the air mattress. While the bladder is being inflated, the solenoid must be periodically disengaged so that the sealing disk seats closing off the air outlet 30, 34 in order to provide to the processor board 20 a reading of the existing pressure in the bladder.

While the prior art valve enclosure assembly 10 has proved to be a useful device, certain problems existed. The sealing disk on the solenoid has a considerable area. The pressure in the bladder of the air mattress constantly acts upon the area of the sealing disk, generating a significant force thereon. Accordingly, the coil spring biasing the sealing disk into the closed configuration must have substantial strength in order to counteract the force exerted by the pressure in the bladder of the air mattress. This further necessitated having a very large solenoid to overcome the bias of the coil spring in order for the solenoid to unseat the sealing disk and open the valve. Such solenoids were prone to overheating. Additionally, with the need to periodically seat the sealing disk in order to monitor the pressure in the bladder the solenoid needed to be actuated many times while a bladder was being inflated, further adding to the heat buildup.

A further problem was that, since the pressure in the bladder was constantly acting on the sealing disk, the sealing disks tended to develop leaks around the periphery resulting in the slow deflation of the bladder. Over time, the sealing disks acquired a layer of dust that contributed to the leaky condition.

Accordingly, there is a need in the industry to minimize bladder leaks, to provide for continuous monitoring of existing pressure in a bladder of the mattress, and to provide for increased production efficiencies. Such production efficiencies include reducing assembly time and eliminating chemical sealants on the valve air enclosure.

SUMMARY OF THE INVENTION

The present invention substantially meets the aforementioned needs of the industry. A new valve design is incorporated in which the pressure in the respective bladders acts to hold the valve in a closed disposition. The area of the valve that is subject to the pressure from the bladder has been substantially reduced. As result of the aforementioned improvements, the actuating solenoids now have to merely unseat the valve against the force of a small spring in combination with a reduced force generated by the pressure in the bladder acting on the valve. Much smaller solenoids are required for this function, thereby reducing the amount of heat generated in the improved valve enclosure assembly.

Additionally, the pressure in the bladders may be continuously monitored by means of a tap on the improved valve enclosure assembly. The new valve design minimizes leaks from the bladders. Further, assembly time for assembling the improved valve enclosure assembly has been substantially reduced with respect to the prior art valve enclosure assembly and chemical sealants formerly used in the assembly have been eliminated.

The improved valve enclosure assembly of the present invention includes at least one air bladder, a pump fluidly coupled to the at least one air bladder for providing compressed air thereto, and a processor for providing commands to the improved valve enclosure assembly during an inflate/deflate cycle. The improved valve enclosure assembly is fluidly coupled intermediate the pump and the at least one air bladder for controlling the inflation of the at least one air bladder. An enclosure defines a substantially fluidly sealed air chamber and has at least one air inlet to the air chamber being fluidly coupled to the pump. A pressure monitor is operably coupled to the processor and is in fluid communication with the at least one bladder for continuously monitoring the pressure in the at least one bladder.

The method of the present invention for effecting a desired pressure in a bladder of an air inflatable mattress is also disclosed. The method includes the steps of:

providing a commanded desired pressure of the bladder;

opening a valve fluid coupled to the bladder;

continuously monitoring the existing pressure in the bladder;

determining the differential between the existing pressure in the bladder and the desired pressure in the bladder;

exhausting air from the bladder through the valve when the differential indicates that the existing pressure in the bladder is greater than the desired pressure;

energizing a pump fluidly coupled to the valve for providing compressed air to the bladder when the differential indicates that the desired pressure in the bladder is greater than the existing pressure in the bladder to inflate the bladder; and closing said valve when the existing pressure in the bladder substantially equals the desired pressure in the bladder.

DETAILED DESCRIPTION OF THE DRAWINGS

DETAILED DESCRIPTION OF THE DRAWINGS

Figure 1:
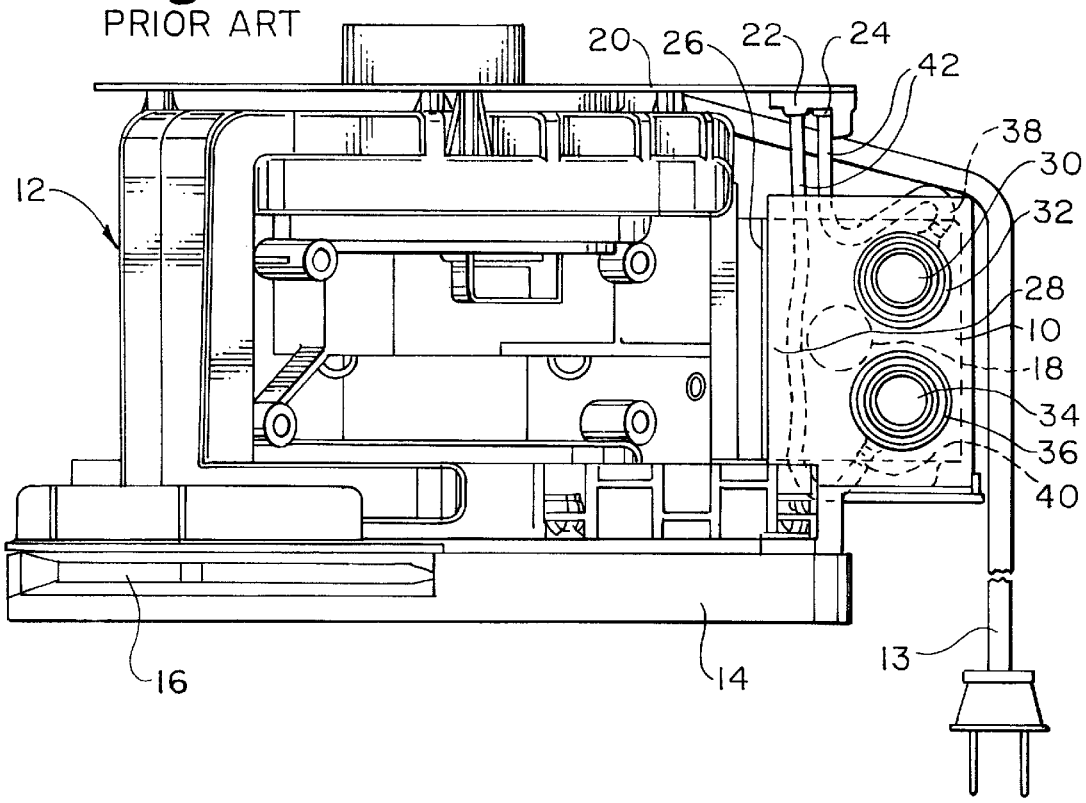
Fig. 1 PRIOR ART
FIG. 1 is a front elevational view of a prior art valve enclosure assembly coupled to a pump.
Figure 2:
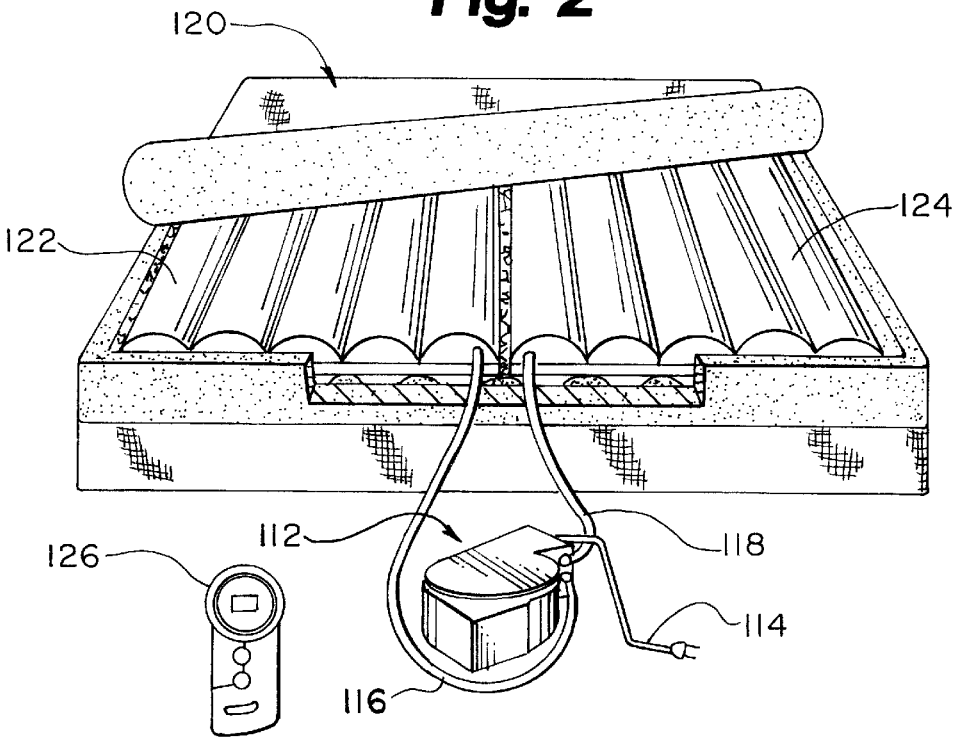
FIG. 2 is an air inflatable mattress system having right and left inflatable bladders.
Figure 3:
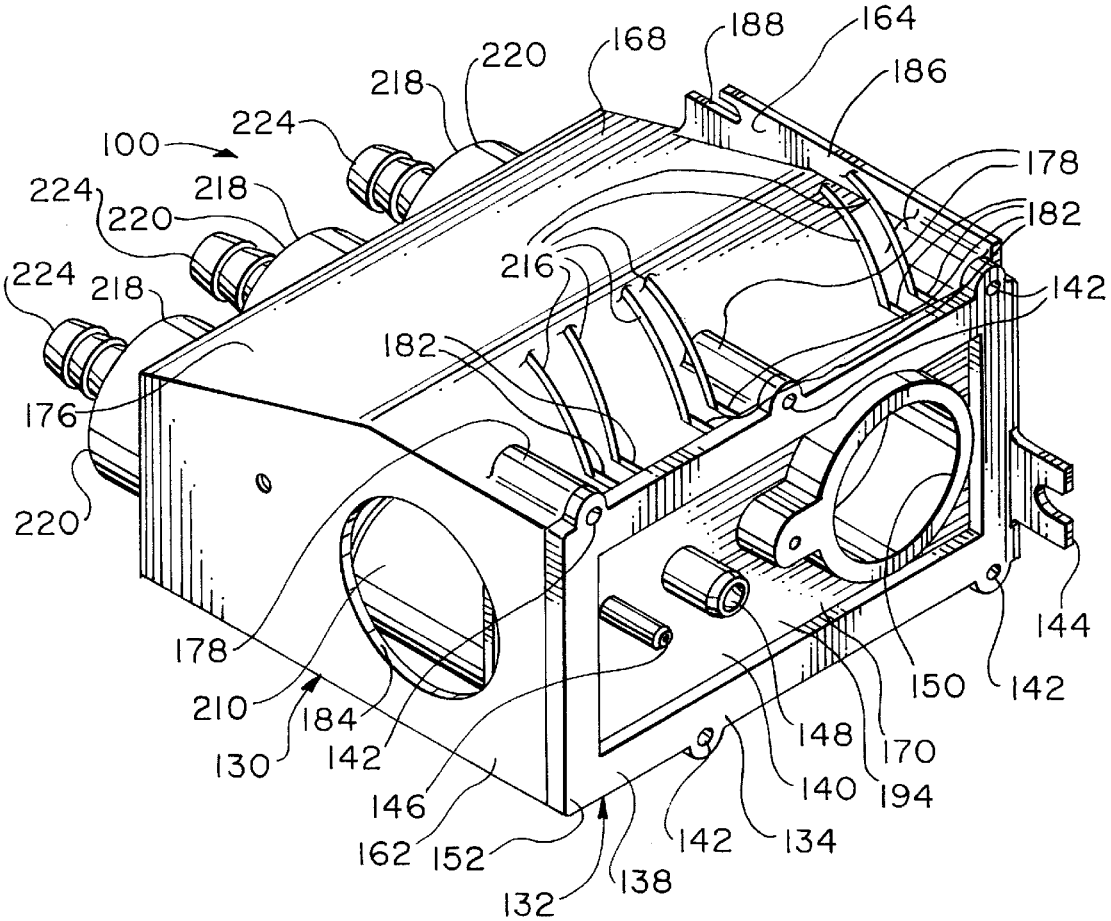
FIG. 3 is a perspective view of the improved valve enclosure assembly of the present invention.

The improved valve enclosure assembly of the present invention is shown generally as 100 in the Figures. Referring to FIG. 2, improved valve enclosure assembly 100 is preferably incorporated into the air mattress system depicted therein. The improved valve enclosure assembly 100 is incorporated into the housing of the pump 112. Pump 112 may be made substantially in accordance with the pump 12 of FIG. 1. Other types of pumps are also suitable for use with the improved valve enclosure assembly 100. Accordingly, pump 112 is electrically powered from household current via cord 114. The pump 112 has an air inlet, an air outlet that is fluidly coupled to the improved valve enclosure assembly 100, and a processor board similar in function to the processor board 20 of prior art FIG. 1. Left and right air hoses 116, 118 are fluidly coupled to the improved valve enclosure assembly 100. The left and right air hoses 116, 118 are fluidly coupled to the left and right bladders 122, 124 respectively of the air inflatable bed 120. A manually operated controller 126 may be utilized to communicate with the processor board 20 to command either increased or decreased pressure in either the left bladder or right bladder 122, 124 as desired, by transmitting a signal to the processor 20. A controller that is wired to the pump 112 may also be used.

Figure 10:
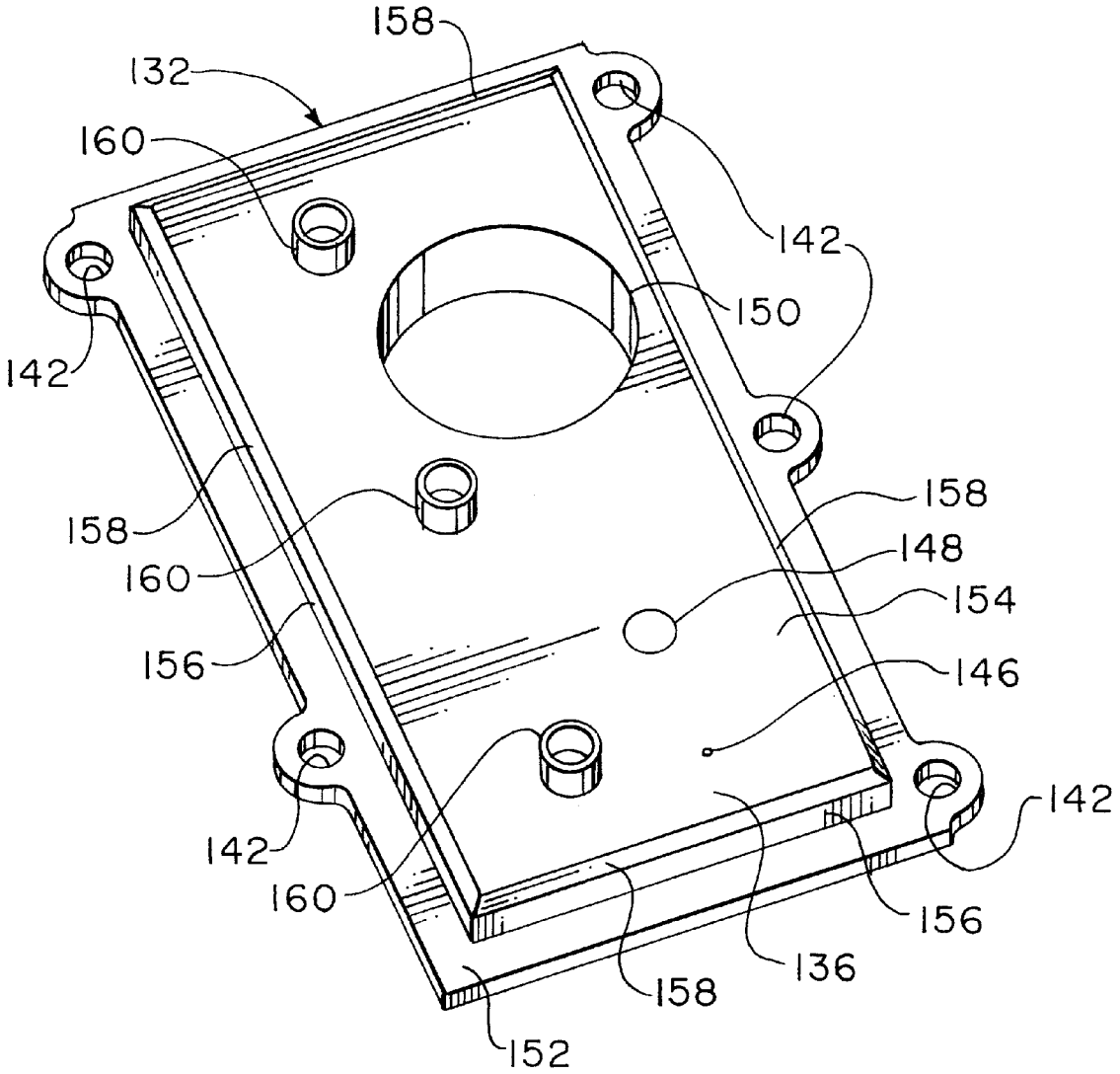
FIG. 10 is perspective view of the inner face of the rear cover of the improved valve enclosure.

The improved valve enclosure assembly 100 has two major structural components; enclosure 130 and rear cover 132. When mated together, the enclosure 130 and rear cover 132 define an air chamber 133 internal thereto. Referring to FIGS. 3, 4, 5 and 10, the rear cover 132 is a generally rectangular-shaped device having an outer face 134 and an inner face 136 (FIG. 10). The outer face 134 has a periphery 138 that extends substantially around a recessed portion 140. The periphery 138 includes a plurality of screw bores 142 at the outer margin thereof. A mounting tab 144 is formed at an edge thereof to facilitate coupling the improved valve enclosure assembly 100 to a particular configuration of the pump 112.

The recessed portion 140 has three air ports defined therein; pressure monitoring port 146, first inlet port 148, and second inlet port 150. The pressure monitoring port 146 is fluidly coupled to the interior of the improved valve enclosure assembly 100 and has an outwardly directed portion designed to receive a small tube thereover for conveying pressure to a pressure sensor.

The first inlet port 148 and second inlet port 150 are used in the alternate depending upon the configuration of the pump 112 that the improved valve enclosure assembly is mated to. The first inlet port 148 has an outwardly directed projecting portion for receiving an air tube thereover. Such air tube may have an inside diameter of approximately five-sixteenths of an inch. A second inlet port 150 is designed to mate flush with a similarly sized outlet port from the pump 112. Depending upon the configuration of the pump 112, either the first inlet port 148 or the second inlet port 150 is formed in a sealed configuration when the rear cover 132 is formed and another inlet port is used with the particular configuration of the pump 112.

Referring to FIG. 10, the inner face 136 of the rear cover 132 is formed in substantially mirror image to the outer face 134. Accordingly, the periphery 152 is recessed with respect to the projected portion 154. The projected portion 154 has four side walls 156 and a beveled upper margin 158. Three inwardly directed gasket hangers 160 are formed on the surface of the inner face 136.

Figure 11:
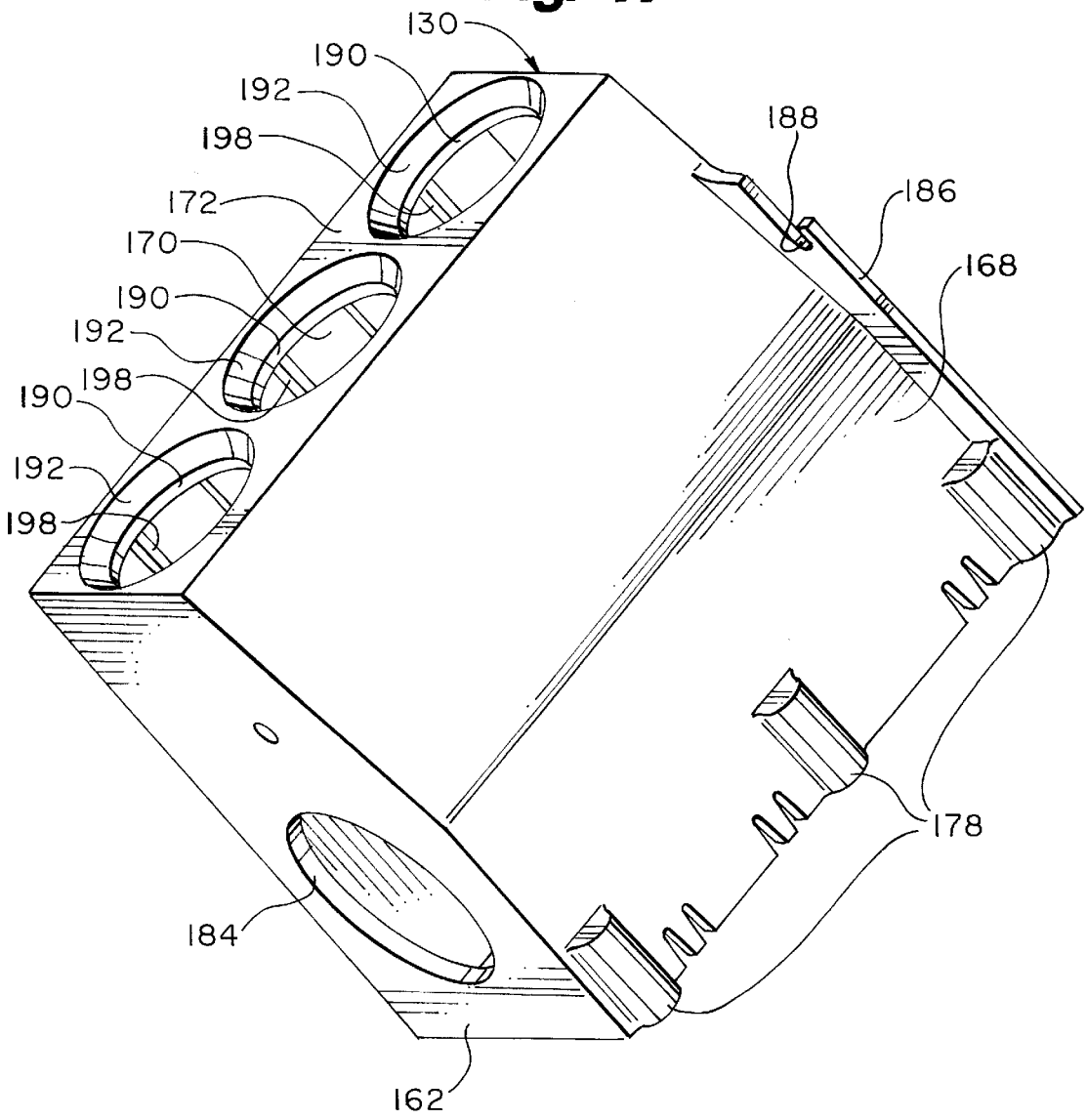
FIG. 11 is a perspective view of the enclosure of the improved valve enclosure.

Referring now to FIGS. 3, 4, 6, and 11, the enclosure 130 that is the second of the two main structural components of the improved valve enclosure assembly 100 is generally box-shaped having two opposed sides 162, 164, a top 168, a bottom 170 and a front face 172, evident in FIG. 11. A rear cover opening 174 is defined opposite the front face 172. In a preferred embodiment, the top 168 has an inclined portion 176 that inclines downward toward the front face 172. For some applications of the improved valve enclosure assembly 100, the inclined portion 176 accommodates disposing the improved valve enclosure assembly 100 next to the generally circular fan housing of the pump 112.

A plurality of screw receivers 178 are disposed peripheral to the rear cover opening 174 of the enclosure 130. The bores 180 defined in the screw receivers 178 are disposed such that the bores 180 will be in registry with the screw bores 142 of the rear cover 132 when the rear cover 132 is positioned over the rear cover opening 174.

A plurality of lead grooves 182 are defined in the top 168 of the enclosure 130 intersecting the rear cover opening 174. A third inlet port 184 is defined in the side 162. Like the second inlet port 150, third inlet port 184 is designed to mate with an outlet port in the fan housing. The third inlet port 184 is an alternate inlet and is formed sealed off if either the first or second inlet ports 148, 150 are to be utilized in the particular application of the improved valve enclosure assembly 100.

For use with a particular configuration of the pump 112, the improved valve enclosure assembly 100 has an upwardly directed flange 186 formed on the side 164. The flange 186 has a screw slot 188 defined therein for coupling to the fan 112 by means of a screw inserted therein and threaded into a bore defined in the housing of the fan 112.

Referring to FIG. 11, the front face 172 of the enclosure 130 preferably has three valve openings 190 formed therein. Certain applications of the improved valve enclosure assembly 100 require the use of either one, two or three valves. In applications where fewer than three valves are needed, one or two of the valve openings may be formed sealed when the enclosure 130 is made. Each of the valve apertures 190 has a circumferential beveled face 192 to assist in the insertion of the valve into the valve aperture 190, as will be later described.

Figures 4, 5:
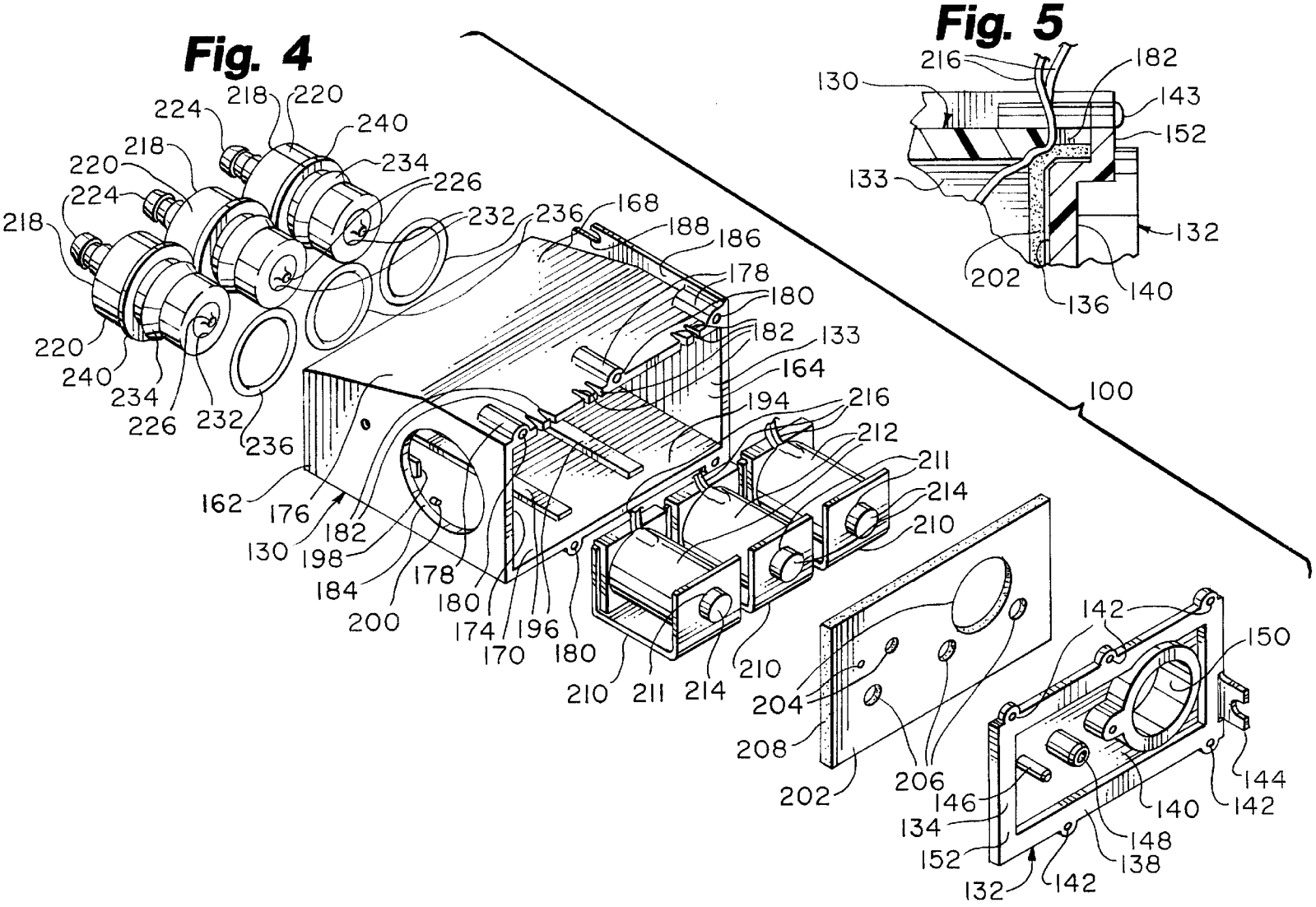
FIG. 4 is an exploded perspective view of the improved valve enclosure assembly.
FIG. 5 is a sectioned side elevational view of the interface of the enclosure, rear cover and the gasket of the improved valve enclosure assembly.
Figure 6:
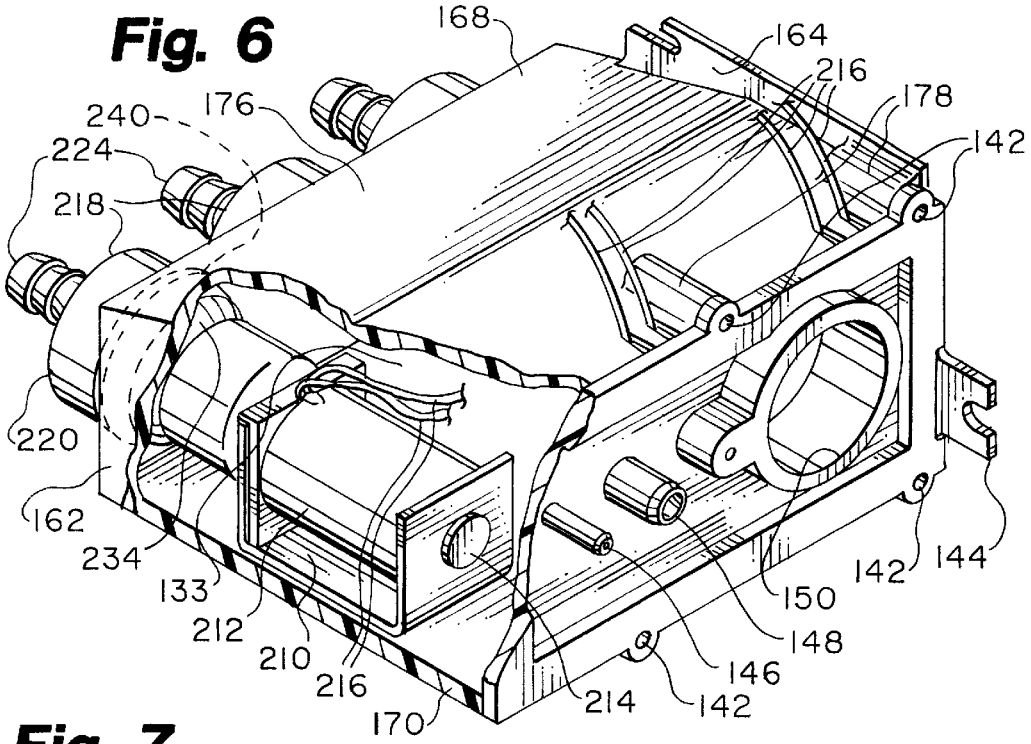
FIG. 6 is a perspective view of the improved valve enclosure assembly with a corner broken out to reveal the solenoid and valve.

Referring to FIG. 4, the inner surface 194 of the bottom 170 has two solenoid guides 196 formed therein, the solenoid guides 196 laterally position solenoids within the improved valve enclosure assembly 100, as will be later described. Additionally, toward the front face 172 of the enclosure 130, solenoid stops 198 are formed on the inner surface of the bottom 170. The solenoid stops 198 act to limit the travel of a solenoid motor in relation to the front face 172. A plurality of screw bores 200 are formed in the bottom 170 through which screws may be passed to affix a solenoid to the bottom 170.

As depicted in FIG. 4, a deformable gasket 202 is interposed between the rear cover 132 and the enclosure 130. The deformable gasket 202 has a plurality of port bores 204 defined therein. The port bores 204 are designed to be in registry with the pressure monitoring port 146, the first inlet port 148, and the second inlet port 150. Additionally, three hanger bores 206 are formed in the deformable gasket 202. When the deformable gasket 202 is mated to the rear cover 132, the hanger bores 206 are positioned over the gasket hangers 160 to properly position the deformable gasket 202 with respect to the rear cover 132. It should be noted that the outer margin 208 of the deformable gasket 202 has substantially the same dimensions as the margin of the periphery 152 of the rear cover 132.

Figure 7:
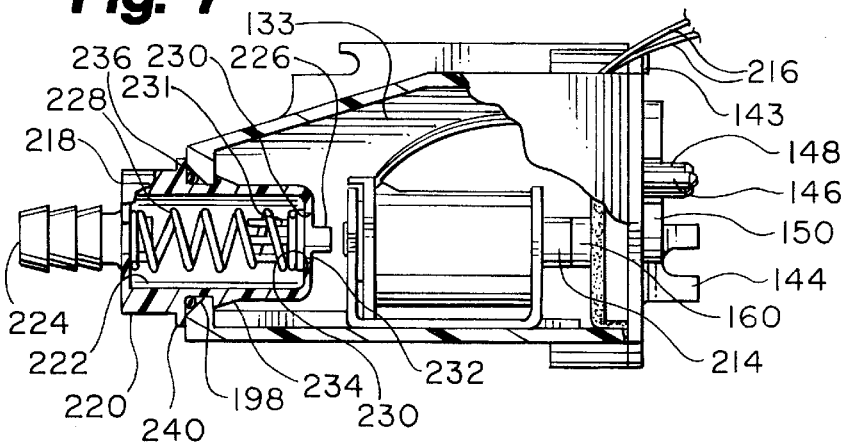
FIG. 7 is a side elevational view of the improved valve enclosure assembly with a portion broken out to reveal the solenoid and valve, with the valve being sectioned and depicted in the sealed disposition.
Figure 8:
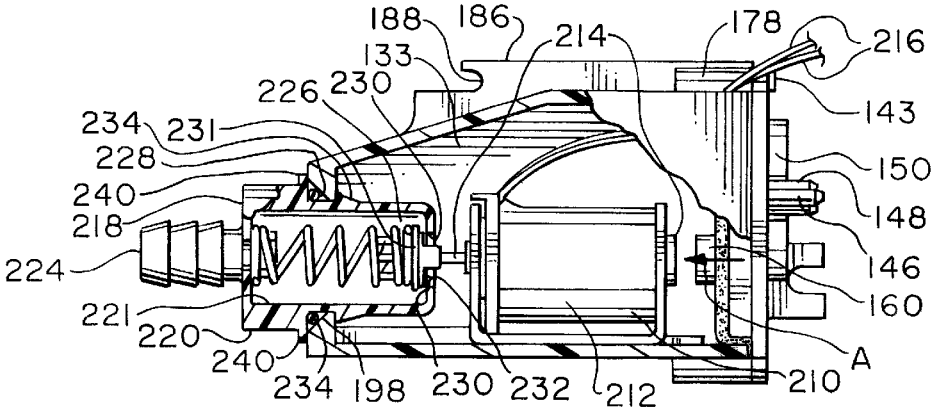
FIG. 8 is a side elevational view of the improved valve enclosure assembly with a portion broken out to reveal the solenoid and valve, with the valve being sectioned and depicted in the open disposition.

At least one paired solenoid 210 and valve 218 are disposed within the improved valve enclosure assembly 100. Each solenoid 210 has a solenoid coil 212 and an axially translatable plunger 214, as depicted in FIGS. 4 and 6–8. A pair of electrical leads 216 are connected to the solenoid coil 212. Application of electrical power to the solenoid coil 212 causes the tip of the translatable plunger 214 to extend from the solenoid 210. FIG. 8 depicts the extended disposition of the plunger 214.

Each of the valves 218 has a valve body 220. An axial air passageway 222 is defined through the valve body 220, as depicted in FIGS. 7 and 8. The air passageway 222 has an air outlet 224. A valve member 226 is disposed at the opposite end of the air passageway 222 from the air outlet 224.

The valve member 226 is biased in the closed disposition depicted in FIG. 7 by a valve spring 228. Preferably, the valve spring 228 exerts about a quarter of a pound of force on the valve member 226. The valve member 226 is biased into contact with a valve seat 230 formed peripheral to the air inlet 232. It should be noted that the O-ring seal 231 of the valve member 226 is substantially smaller in area than the area of the prior art plunger in order to minimize the force necessarily exerted by the valve spring 228 acting on the O-ring seal 231 of the valve member 226.

The valve body 220 has a ramped snap fit ring 234 formed slightly spaced apart from an expanded diameter portion 240 of the valve body 220. An O-ring 236 is preferably disposed between the ramped snap fit ring 234 and the expanded diameter portion 240.

Figure 9:
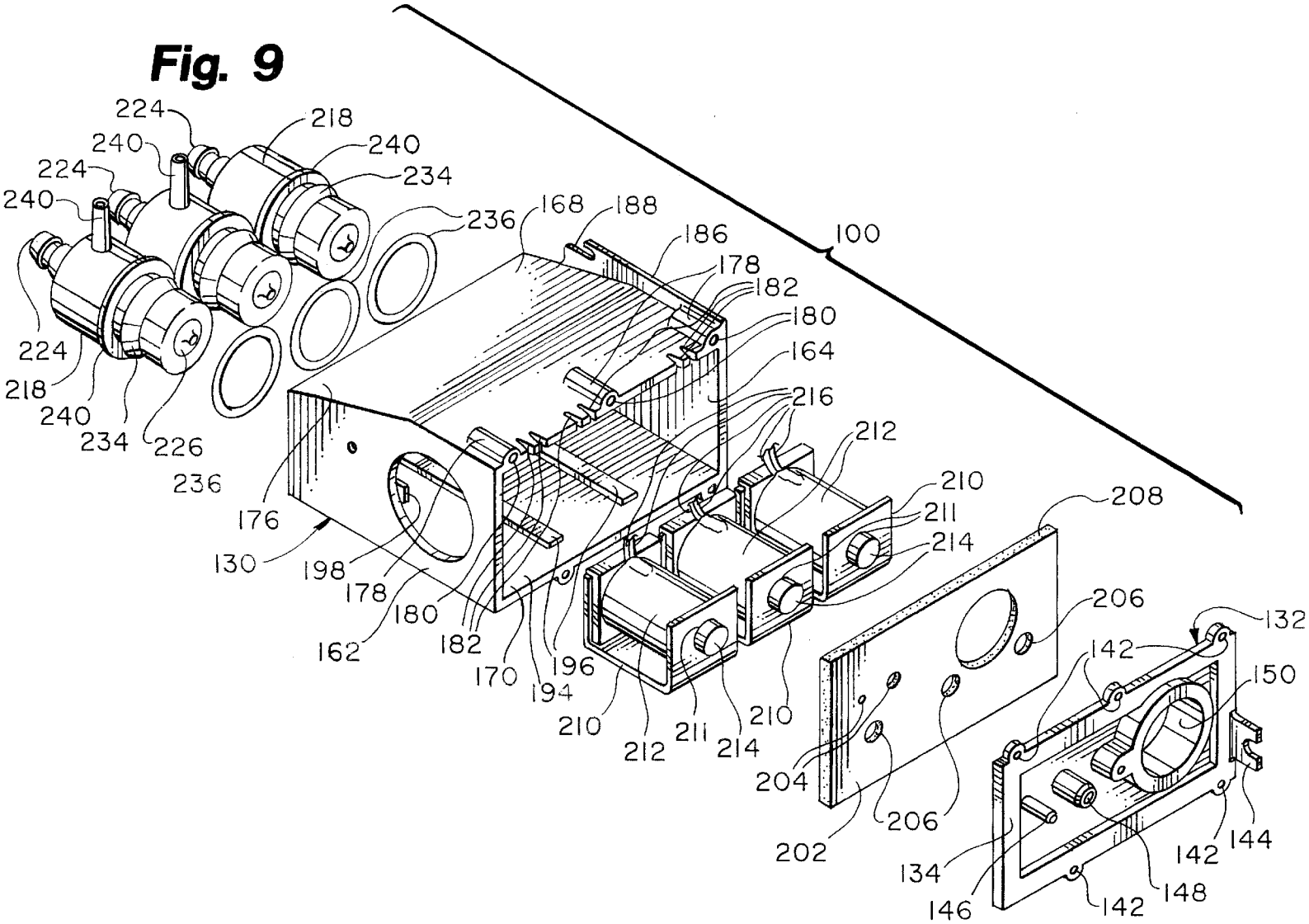
FIG. 9 is an exploded perspective view of the improved valve enclosure assembly having two valves with pressure taps.

In an alternative preferred embodiment depicted in FIG. 9, a pressure monitor tab 240 is disposed on the valve body 220 of two of the valves 218. The pressure monitor tab 240 has an air passageway 222 defined therein that is fluidly coupled to the air passageway 222 of the valve body 220.

In assembly, the valves 218 are press fit into the valve openings 190. Preferably a small press is utilized to insert the valves 218 into the valve openings 190. The ramped snap-fit ring 234 of the valve 218 rides up the beveled face 192 of the valve opening 190 as the valve 218 is pressed into the valve opening 190. As the ramped snap-fit ring 234 passes through the valve opening 190 and compressively engages the inner peripheral surface of the valve opening 190, this disposition puts the O-ring 236 into a compressive sealed engagement between the expanded diameter portion 240 of the valve 218 and the beveled face 192 of the valve opening 190.

A solenoid 210 is paired with each valve 218. Solenoid 210 is slidably positioned by the solenoid guides 196 and slid into the enclosure 130. Travel into the enclosure 130 is arrested by the solenoid 210 coming into contact with the solenoid stops 198. The solenoid 210 is then held in position by screws passing through the screw bores 200 into the underside of the solenoid 210. The leads 216 of the solenoid 210 are passed out of the enclosure 130 through the lead grooves 182. Plunger 214 is inserted into an axial bore 211 defined in the coil 212. The plunger 214 is free to translate in the bore. At its right-most disposition, as depicted in FIG. 7, the plunger 214 is stopped by the gasket hanger 160. At its left-most disposition, as depicted in FIG. 8, the plunger 214 acts to open the valve 218.

The gasket 202 is then positioned on the inner face 136 of the rear cover 132 by means of the gasket hangers 160. The rear cover 132 and the gasket 202 are then positioned in registry with the rear cover opening 174 of the enclosure 130. The rear cover 132 is affixed to the enclosure 130 by screws 143 passed through the screw bores 142 and engaging the screw receivers 178 of the enclosure 130. As the screws are drawn up, the periphery of the deformable gasket 202 is compressed between the margin of the rear cover opening 174 and the side walls 156 of the projected portion 154 of the rear cover 132, as depicted in FIG. 5. The compression of the deformable gasket therein fluidly seals the rear cover 132 and the enclosure 130, including sealing around the solenoid leads 216 that are passed out of the enclosure 130 through the lead grooves 182.

The improved valve enclosure assembly 100 is designed to be utilized with a number of different pump types, pump configurations, and air inflatable beds 120. Accordingly, some inflatable beds 120 have only a single bladder. In such case, a single solenoid 210 and valve 218 is utilized with the improved valve enclosure assembly 100. With the single bladder inflated to a given pressure, that pressure bears on the back side of the valve member 226, thereby assisting the valve spring 228 in biasing the valve member 226 against the valve seat 230. When an increased pressure in the bladder is desired, the pump 112 is energized and floods the improved valve enclosure assembly with compressed air. At this point in the inflate/deflate cycle, the valve 218 and the solenoid 210 are in the sealed disposition as depicted in FIG. 7.

The solenoid 210 is then actuated and the translatable plunger 214 advances from the disposition in contact with the gasket hanger 160, as depicted in FIG. 7, into contact with the valve member 226 to unseat the valve member 226 from the valve seat 230, as depicted by arrow A in FIG. 8. In a preferred embodiment, the combined force of the valve spring 228 and the air pressure from the bladder against which the solenoid 210 must act is less than one pound, with the preferred range of force being between 0.25 and 0.4 pounds and the optimum force being approximately 0.4 pounds. When the valve member 226 is unseated, compressed air passes through the air passageway 222 in the valve body to inflate the bladder.

When the inflate/deflate cycle commanded by the controller 126 calls for deflation of the bladder, the pump 112 is left unenergized and the valve 218 is opened as previously described. Certain types of pumps 112 permit the exhausting of compressed air through the pump 112 by effectively running the pump in reverse. With such types of pumps 112, this is the preferred means of deflating the bladder.

Certain types of pumps 112 are fluidly sealed when they are in the unpowered state. Accordingly, an alternative route to deflate the bladder must be provided. In such case, a second solenoid 210 and valve 218 is incorporated in the improved valve enclosure assembly 100. The second valve 218 simply opens into the interior of the housing of the pump 112. Accordingly, to deflate the bladder the first valve 218 is opened as previously described and the second valve 218 is also opened, thereby permitting compressed air from the bladder to flow through the first valve 218 into the enclosure 130 and out through the second valve 218 to the interior of the housing of the pump 112, from which the air is ultimately exhausted.

As depicted in FIG. 2, inflatable bed 120 may have a left bladder 122 and a right bladder 124. In such case, the improved valve enclosure assembly 100 must incorporate two solenoids 210 and two valves 218, one valve 218 being connected to the left air hose 116 and the second valve 218 being connected to the right air hose 118. The two valves function to inflate and deflate the left and right air bladders 122, 124 as previously described for the single bladder embodiment. In the case of using a pump 112 that is sealed when powered down, the third valve 218 is utilized to exhaust air from the left and right bladders 122, 124 as previously described in relation to the single bladder embodiment.

Further, with the controller 126 as depicted in FIG. 2, a desired inflation of either the left bladder 122 or the right bladder 124 may be commanded. Such command may require either an inflation or a deflation of the left or right bladders 122, 124. In order to meet the command, the processor of the pump 112 must be able to continuously monitor pressure in the respective left bladder or right bladder 122, 124 as desired. With some configurations of the pump 112, monitoring can be provided by coupling the pressure monitoring port 146 of the rear cover 132 to the processor.

Alternatively, with other types of pumps 112, such monitoring must be taken from the valve 218 and may not be continuous, as provided for above. Accordingly, the valves 218 include the optional pressure monitor tab 240. In such case, the pressure monitor tab 240 of the valve 218 to the left pressure sensor 22, as depicted in FIG. 1. The valve 218 that is fluidly coupled to the right bladder 124 includes a fluid coupling from the right pressure sensor 24 to the pressure monitor tab 240.

It will be recognized that the foregoing embodiments are merely exemplary of the invention, and that modifications and extensions will be obvious which do not depart from the scope of the invention as defined by the following claims.

What is claimed is:

1. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump;

pressure monitor means being operably coupled to the processor and being in fluid communication with the at least one bladder for continuously monitoring the pressure in the at least one bladder during an inflate/deflate cycle by monitoring the pressure in the air chamber, and at least one valve being fluidly sealingly disposed in a valve aperture defined in the enclosure by a snap-fit engagement therewith and being in fluid communication with both the exterior of the enclosure and with the air chamber.

2. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump, a plurality of guides and stops being disposed within the enclosure for correctly positioning components within the enclosure; and pressure monitor means being operably coupled to the processor and being in fluid communication with the at least one bladder for continuously monitoring the pressure in the at least one bladder.

3. The improved valve enclosure assembly of claim 1 further including at least one solenoid operated valve disposed within the enclosure, said plurality of guides and stops for disposing the solenoid with respect to the valve.

4. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump;

at least one valve being disposed within the enclosure, the at least one valve being snap fit in an aperture defined in a wall of the enclosure; and pressure monitor means being operably coupled to the processor and being in fluid communication with the at least one bladder for continuously monitoring the pressure in the at least one bladder.

5. The improved valve enclosure assembly of claim 4 wherein the at least one valve has a circumferential ramped face, said ramped face for compressively engaging a circumferential beveled face of the aperture to effect the snap fit of the at least one valve.

6. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump, the enclosure being formed of an enclosure portion and a rear cover portion, a flexible seal being compressively interposed between the enclosure portion and a rear cover portion to effect a substantially fluid tight seal therebetween; and pressure monitor means being operably coupled to the processor and being in fluid communication with the at least one bladder for continuously monitoring the pressure in the at least one bladder.

7. The improved valve enclosure assembly of claim 1 wherein the enclosure further includes a plurality of lead grooves defined in the enclosure portion proximate the rear cover portion, said lead grooves for passing electrical leads into the enclosure.

8. The improved valve enclosure assembly of claim 7 wherein the flexible seal fluidly seals the lead wires disposed in the lead grooves.

9. A method of effecting a desired pressure in a bladder of an air inflatable mattress, comprising the steps of:

providing a commanded desired pressure of the bladder;

opening a valve fluid coupled to the bladder;

continuously monitoring the existing pressure in the bladder at a tap on a valve enclosure assembly;

determining the differential between the existing pressure in the bladder and the desired pressure in the bladder;

exhausting air from the bladder through the valve when the differential indicates that the existing pressure in the bladder is greater than the desired pressure;

energizing a pump fluidly coupled to the valve for providing compressed air to the bladder when the differential indicates that the desired pressure in the bladder is greater than the existing pressure in the bladder to inflate the bladder; and closing said valve when the existing pressure in the bladder substantially equals the desired pressure in the bladder.

10. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump;

at least one valve operably coupled to the enclosure being in selective fluid communication with the air chamber and being in fluid communication with the at least one air bladder for selectively fluidly coupling the air chamber to at least one air bladder, the at least one valve having a valve housing, pressure monitor means being formed integral with said valve housing; and pressure monitor means being operably coupled to the processor and being in fluid communication with the at least one valve for monitoring the pressure in the at least one bladder.

11. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump;

at least one valve operably coupled to the enclosure being in selective fluid communication with the air chamber and being in fluid communication with the at least one air bladder for selectively fluidly coupling the air chamber to at least one air bladder, the at least one valve being fluidly sealingly disposed in a valve aperture defined in the enclosure by a snap-fit engagement therewith and being in fluid communication with both the exterior of the enclosure and with the air chamber; and pressure monitor means being operably coupled to the processor and being in fluid communication with the at least one valve for monitoring the pressure in the at least one bladder.

12. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump, a plurality of guides and stops being disposed within the enclosure for correctly positioning components within the enclosure;

at least one valve operably coupled to the enclosure being in selective fluid communication with the air chamber and being in fluid communication with the at least one air bladder for selectively fluidly coupling the air chamber to at least one air bladder; and pressure monitor means being operably coupled to the processor and being in fluid communication with the at least one valve for monitoring the pressure in the at least one bladder.

13. The improved valve enclosure assembly of claim 1 further including at least one solenoid operated valve disposed within the enclosure, said plurality of guides and stops for disposing the solenoid with respect to the valve.

14. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump, at least one valve being disposed within the enclosure, the at least one valve being snap fit in an aperture defined in a wall of the enclosure;

at least one valve operably coupled to the enclosure being in selective fluid communication with the air chamber and being in fluid communication with the at least one air bladder for selectively fluidly coupling the air chamber to at least one air bladder; and pressure monitor means being operably coupled to the processor and being in fluid communication with the at least one valve for monitoring the pressure in the at least one bladder.

15. The improved valve enclosure assembly of claim 14 wherein the at least one valve disposed therein has a circumferential ramped face, said ramped face for compressively engaging a circumferential beveled face of the aperture to effect the snap fit of the at least one valve.

16. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:

an enclosure defining a substantially fluidly sealed air chamber and having at least one air inlet to the air chamber being fluidly coupled to the pump, the enclosure being formed of an enclosure portion and a rear cover portion, a flexible seal being compressively interposed between the enclosure portion and a rear cover portion to effect a substantially fluid tight seal therebetween;

at least one valve operably coupled to the enclosure being in selective fluid communication with the air chamber and being in fluid communication with the at least one air bladder for selectively fluidly coupling the air chamber to at least one air bladder; and pressure monitor means being operably coupled to the processor and being in fluid communication with the at least one valve for monitoring the pressure in the at least one bladder.

17. The improved valve enclosure assembly of claim 16 wherein the enclosure further includes a plurality of lead grooves defined in the enclosure portion proximate the rear cover portion, said lead grooves for passing electrical leads into the enclosure.

18. The improved valve enclosure assembly of claim 16 wherein the flexible seal fluidly seals the lead wires disposed in the lead grooves.

* * * * *

UNITED STATES PATENT AND TRADEMARK OFFICE

CERTIFICATE OF CORRECTION

PATENT NO. : 5,904,172
APPLICATION NO. : 08/901144
DATED : May 18, 1999
INVENTOR(S) : Gifft et al.

It is certified that error appears in the above-identified patent and that said Letters Patent is hereby corrected as shown below:

In the Claims

In column 8, line 66, in Claim 3, delete “claim 1” and insert --claim 2--, therefor In column 9, line 50, in Claim 7, delete “claim 1” and insert --claim 6--, therefor In column 11, line 19, in Claim 13, delete “claim 1” and insert --claim 12--, therefor Signed and Sealed this
Sixth Day of May, 2014

Michelle K. Lee

Michelle K. Lee
*Deputy Director of the United States Patent and Trademark Office*

US005904172C1

(12) EX PARTE REEXAMINATION CERTIFICATE (9998th)

United States Patent
Gifft et al.

(10) Number: US 5,904,172 C1
(45) Certificate Issued: Jan. 3, 2014

(54) VALVE ENCLOSURE ASSEMBLY

(75) Inventors: James Edwin Gifft, Maple Grove, MN (US); Paul James Mahoney, Stillwater, MN (US)

(73) Assignee: Select Comfort Corporation, Plymouth, MN (US)

Reexamination Request:
No. 90/012,456, Oct. 17, 2012

Reexamination Certificate for:

| | |
|---|---|
| Patent No.: | **5,904,172** |
| Issued: | **May 18, 1999** |
| Appl. No.: | **08/901,144** |
| Filed: | **Jul. 28, 1997** |

(51) Int. Cl.
*A47C 27/08* (2006.01)

(52) U.S. Cl.
USPC ... 137/224; 137/271; 137/596.16; 137/596.2; 5/710; 5/713

(58) Field of Classification Search
None
See application file for complete search history.

(56) References Cited

To view the complete listing of prior art documents cited during the proceeding for Reexamination Control Number 90/012,456, please refer to the USPTO's public Patent Application Information Retrieval (PAIR) system under the Display References tab.

*Primary Examiner* — Joseph A. Kaufman

(57) ABSTRACT

An improved valve enclosure assembly for use with an air inflatable mattress includes at least one air bladder, a pump fluidly coupled to the at least one air bladder for providing compressed air thereto, and a processor for providing commands to the improved valve enclosure assembly during an inflate/deflate cycle. The improved valve enclosure assembly is fluidly coupled intermediate the pump and the at least one air bladder for controlling the inflation of the at least one air bladder. An enclosure defines a substantially fluidly sealed air chamber and has at least one air inlet to the air chamber being fluidly coupled to the pump. A pressure monitor is operably coupled to the processor and is in fluid communication with the at least one bladder for continuously monitoring the pressure in the at least one bladder. A method of effecting a desired pressure in a bladder of an air inflatable mattress is also disclosed.

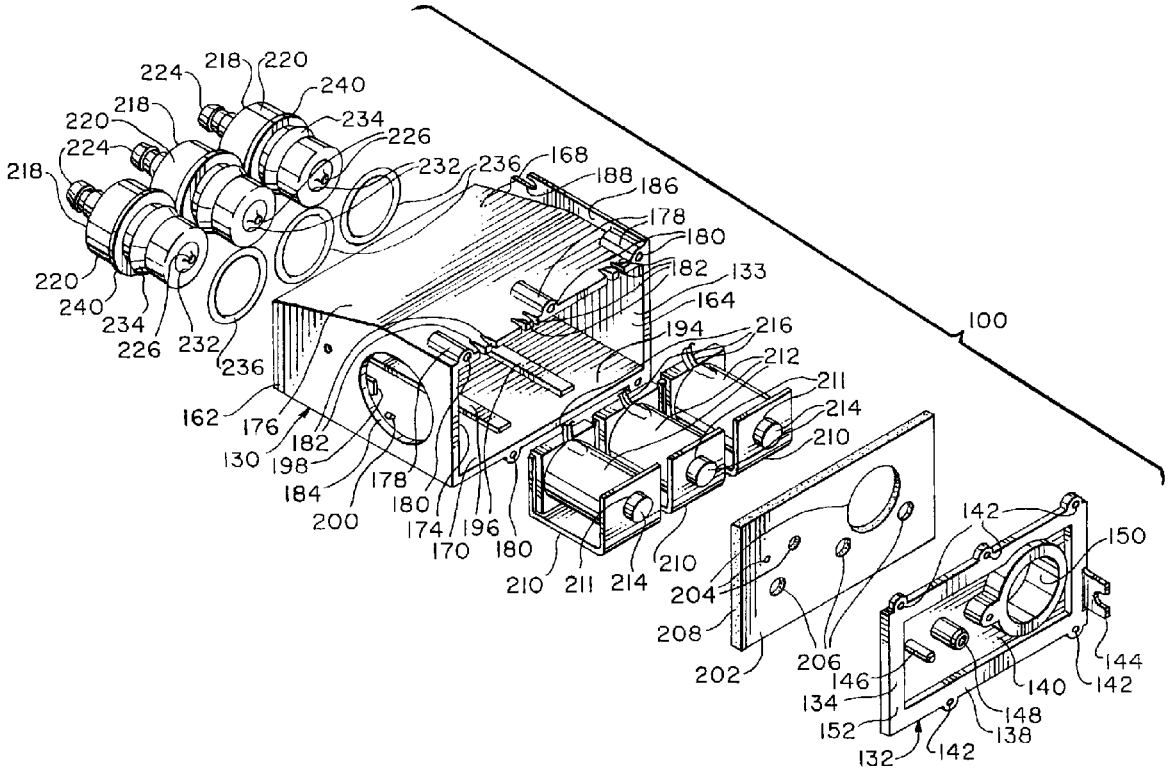

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2, 4-6, 11, 12 and 14-18 is confirmed.

Claims 1 and 10 are cancelled.

Claim 9 is determined to be patentable as amended.

New claims 19-25 are added and determined to be patentable.

Claims 3, 7, 8 and 13 were not reexamined.

9. A method of effecting a desired pressure in a bladder of an air inflatable mattress, comprising the steps of:

providing a commanded desired pressure of the bladder;

opening a valve [fluid] *fluidly* coupled to the bladder, *wherein the valve is one of a plurality of valves at least partially contained within, or formed integral to, a substantially fluidly sealed air chamber of a valve enclosure assembly*;

continuously monitoring the existing pressure in the bladder at a tap on [a] *the* valve enclosure assembly, *the tap defining an opening through the valve enclosure assembly and into an interior of the air chamber*;

determining the differential between the existing pressure in the bladder and the desired pressure in the bladder;

exhausting air from the bladder through the valve when the differential indicates that the existing pressure in the bladder is greater than the desired pressure;

energizing a pump fluidly coupled to the valve for providing compressed air to the bladder when the differential indicates that the desired pressure in the bladder is greater than the existing pressure in the bladder to inflate the bladder; and closing said valve when the existing pressure in the bladder substantially equals the desired pressure in the bladder.

*19. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:*

*an enclosure defining a substantially fluidly sealed air chamber and having at least one air inlet to the air chamber being fluidly coupled to the pump;*

*pressure monitor means including a sensor being operably coupled to the processor and being in fluid communication with the at least one bladder through a pressure monitoring port defining an opening the enclosure and into an interior of the air chamber, the sensor configured for continuously monitoring the pressure in the at least one bladder during an inflate/deflate cycle by monitoring the pressure in the air chamber, and*

*two or more valves being fluidly sealingly disposed in respective valve apertures defined in the enclosure by a snap-fit engagement therewith and being in fluid communication with both the exterior of the enclosure and with the air chamber.*

*20. An improved valve enclosure assembly for use with an air inflatable mattress having at least one air bladder inflated by compressed air, a pump fluidly coupled to the at least one air bladder for providing compressed air thereto, and a processor for providing commands to the improved valve enclosure assembly during an inflate/deflate cycle, the improved valve enclosure assembly being fluidly coupled intermediate the pump and the at least one air bladder for controlling the inflation of the at least one air bladder, comprising:*

*an enclosure defining a substantially fluidly sealed air chamber and having at least one air inlet to the air chamber being fluidly coupled to the pump, the enclosure being formed of an enclosure portion and a rear cover portion, a flexible seal being compressively interposed between the enclosure portion and the rear cover portion to effect a substantially fluid tight seal therebetween;*

*two or more valves being in fluid communication with both the exterior of the enclosure and with the air chamber; and*

*pressure monitor means including a sensor being operably coupled to the processor and being in fluid communication with the at least one bladder through a pressure monitoring port defining an opening through the enclosure and into an interior of the air chamber, the pressure sensor configured for continuously monitoring the pressure in the at least one bladder during an inflate/deflate cycle.*

*21. The improved valve enclosure assembly of claim 20 wherein the pressure monitoring port is disposed on the rear cover portion of the enclosure.*

*22. The improved valve enclosure assembly of claim 2 further including at least one solenoid configured to operate a valve, wherein the at least one solenoid is at least partially received within the air chamber of the enclosure.*

*23. The improved valve enclosure assembly of claim 2 further including at least one solenoid configured to operate a valve, wherein the at least one solenoid is positioned entirely within the air chamber of the enclosure.*

*24. The improved valve enclosure assembly of claim 2 wherein the enclosure is formed of an enclosure portion and a rear cover portion.*

*25. The improved valve enclosure assembly of claim 24 wherein a flexible seal is compressively interposed between the enclosure portion and the rear cover portion to effect a substantially fluid tight seal therebetween.*

* * * * *